United States Patent [19]

Visinand

[11] Patent Number: 4,514,868

[45] Date of Patent: May 7, 1985

[54] BATHTUB

[76] Inventor: Jean-Claude Visinand, 3535 Papineau, Apt. 2405, Montreal, Quebec, Canada, H2K 4J9

[21] Appl. No.: 489,046

[22] Filed: Apr. 27, 1983

[51] Int. Cl.[3] ..... E03C 1/02

[52] U.S. Cl. ..... 4/541; 4/568; 4/591

[58] Field of Search ..... 4/541, 542, 584, 591, 4/567, 569, 570

[56] References Cited

U.S. PATENT DOCUMENTS

| | | | |
|---|---|---|---|
| 2,198,631 | 4/1940 | More | 4/568 |
| 2,575,636 | 11/1951 | Patch | 4/541 |
| 2,705,329 | 4/1955 | Exton-Porter | 4/584 |
| 3,396,412 | 8/1968 | Francom . | |
| 3,579,667 | 5/1971 | Giglio | 4/591 |
| 3,614,792 | 10/1971 | Sierant | 4/568 |
| 3,662,406 | 5/1972 | Giglio | 4/541 |

*Primary Examiner*—Henry K. Artis

*Attorney, Agent, or Firm*—Schwartz, Jeffery, Schwaab, Mack, Blumenthal & Koch

[57] ABSTRACT

The invention is concerned with a bathtub having a bottom wall, a pair of sidewalls and opposed first and second end walls integrally formed with the bottom wall, the second end wall being angularly inclined outwardly to define an abutment surface against which a person lying in the tub may rest, and water inlet means for filling the tub with a mixture of hot and cold water. According to the invention, the water inlet means extends through one of the sidewalls and is adapted to discharge a flow of hot and cold water along the one sidewall in a direction towards the second end wall so as to impart to the water a circulatory movement as it fills the tub and to thereby uniformly mix the hot and cold water and provide a uniform water mixture having a substantially constant temperature.

4 Claims, 4 Drawing Figures

BATHTUB

BACKGROUND OF THE INVENTION

The present invention relates to improvements in bathtubs. More particularly, the invention is concerned with a bathtub having improved water inlet means for filling the tub with a mixture of hot and cold water.

Various systems have been proposed for discharging water into a bathtub for filling same while satisfying at the same time a specific need. In U.S. Pat. No. 2,198,631, for example, the conventional water faucets adjacent the drain at one end of the tub are replaced by a duct connected to hot and cold water supply pipes via a mixing valve and leading to one or more nozzles extending through the slanted wall of the tub at the other end thereof. When the mixing valve is turned on, the water enters the tub at the end opposite the drain and flows downwardly against the sides of the tub to fill the tub and, after the tub has been used, to thoroughly rinse the same and drive the water toward the drain. Thus, the water inlet arrangement proposed in this patent serves the dual purpose of filling the tub for a bath and later automatically rinsing it toward the drain.

In U.S. Pat. No. 3,396,412, on the other hand, the conventional water faucets for filling the bathtub with water are retained, but in addition thereto, there is provided a pump with a conduit for recirculating the bath water for the comfort of the user. The pump which is located under the faucets at one end of the tub drains water from the tub and pumps this water through an imbedded conduit leading to a nozzle recessed in a head rest arranged at the other end of the tub. The pump water is mixed with air in the recessed nozzle through a remote air vent and discharged from the nozzle in the form of an aerated jet or spray over the neck and shoulders of the body.

Although the above arrangements may be satisfactory for their own specific purposes, they do not overcome the problem of non-uniform mixture of hot and cold water and the resulting water temperature fluctuations one is forever faced with when filling a tub for a bath. Indeed, with the conventional faucets located at the front end of the tub, the mixture of hot and cold water issuing from the faucet enters the tub at the front end and gradually flows towards the back end of the tub to fill the same, causing the heat of the water entering the tub to dissipate through the tub walls and escape to the open atmosphere as the water moves towards the back end. As a consequence, then are considerable temperature fluctuations within the bath water such that the water temperature will be greater at the front end of the tub than at the back end. Thus, prior to entering the tub, the user will have to churn the water around the tub with his hand in order to uniformly mix the hot and cold water and provide a uniform water mixture having a constant temperature.

SUMMARY OF THE INVENTION

It is therefore an object of this invention to overcome the above problems and to provide a bathtub having improved water inlet means for filling the tub with a mixture of hot and cold water while at the same time uniformly mixing the hot and cold water to produce a uniform water mixture having a substantially constant temperature.

In accordance with the invention, there is provided in a bathtub having a bottom wall, a pair of sidewalls and opposed first and second end walls integrally formed with the bottom wall, the second end wall being angularly inclined outwardly to define an abutment surface against which a person lying in the tub may rest, and water inlet means for filling the tub with a mixture of hot and cold water, the improvement wherein the water inlet means extends through one of the sidewalls and is adapted to discharge a flow of hot and cold water along the one sidewall in a direction towards the second end wall so as to impart to the water a circulatory movement as it fills the tub and to thereby uniformly mix the hot and cold water and provide a uniform water mixture having a substantially constant temperature.

Thus, by discharging the water along a sidewall of the tub and towards the inclined end wall thereof, the water entering the tub will contour the tub walls and thereby flow within the tub along a circular path. As the water fills the tub, the circulatory movement of the water entering the latter will also impart to the bath water the same movement. As a result, there is a simultaneous mixing of the hot and cold water such that a uniform water mixture having a substantially constant temperature is obtained during the filling of the tub.

According to a preferred embodiment of the invention, the sidewall of the tub along which the water is discharged is provided with a flow directing channel defined by an elongated recess having first and second ends and tapering towards the second end to merge with the sidewall in a direction towards the second end wall, and an end wall at the first end of the recess extending transversely thereto. The water inlet means, on the other hand, comprises a water discharge nozzle integral with the transverse end wall and extending therethrough in substantial axial alignment with the longitudinal axis of the recess, the nozzle being connected to hot and cold water supply means.

BRIEF DESCRIPTION OF THE DRAWINGS

Further features and advantages of the invention will become more readily apparent from the following description of a preferred embodiment thereof as illustrated by way of example in the accompanying drawings, wherein.

DESCRIPTION OF PREFERRED EMBODIMENTS

Figure 1:
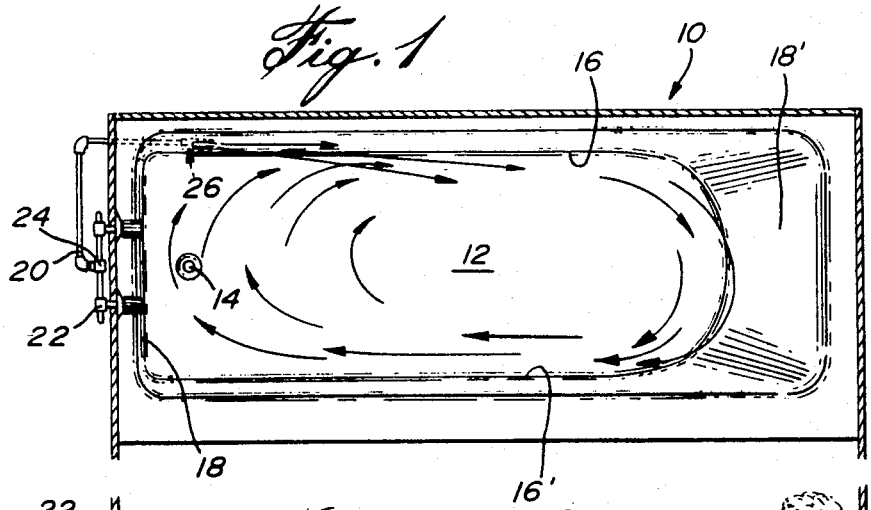
FIG. 1 is a plan view of a bathtub according to the invention.
Figure 2:
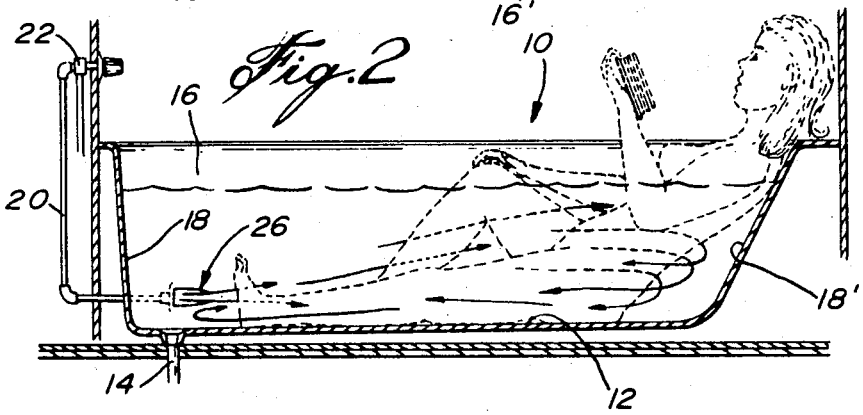
FIG. 2 is a sectional elevation view of the bathtub illustrated in FIG. 1.

Referring to the drawings, and more particularly to FIGS. 1 and 2, there is illustrated a bathtub generally designated by reference numeral 10. The tub 10 includes a bottom wall 12 provided with a drain 14 at the front end of the tub, and a pair of sidewalls 16,16' and front and back end walls 18,18' which are integrally formed with the bottom wall 12. The back end wall 18' is angularly inclined outwardly to define an abutment surface against which a person lying in the tub may rest, as shown in FIG. 2. A mixture of hot and cold water is discharged through the pipe 20 via hot and cold water control valves 22 and 24. The pipe 20 leads to a flow directing channel 26 which is provided in the sidewall 16 of the tub and disposed adjacent the bottom wall 12 and the front end wall 18, such that the water is discharged into the tub along the sidewall 16 in a direction towards the back end wall 18'.

Figure 3:
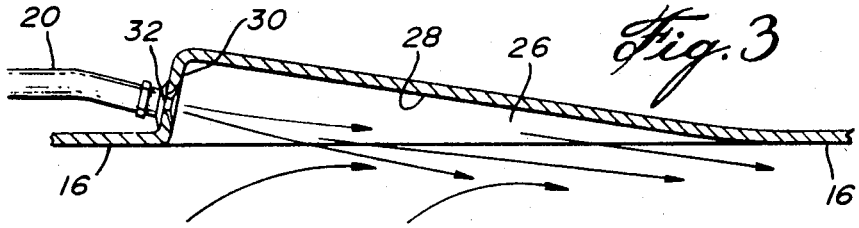
FIGS. 3 and 4 are respectively fragmentary sectional and perspective views showing how the water enters the tub to flow along a sidewall thereof.
Figure 4:
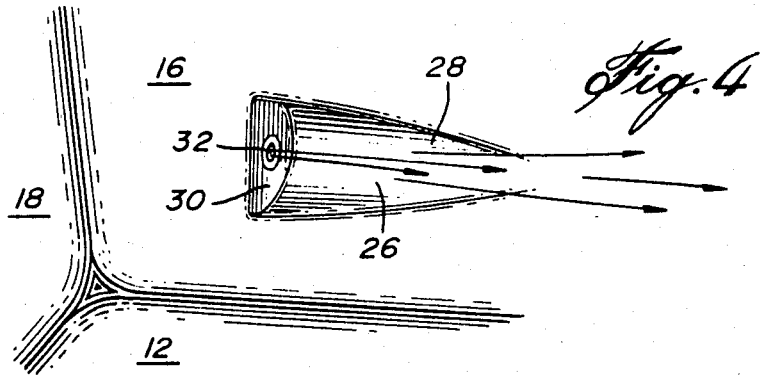

As best shown in FIGS. 3 and 4, the flow directing channel 26 is defined by an elongated recess 28 which is formed in the sidewall 16 and tapers in a direction towards the back end wall 18' to merge with the sidewall 16, and an end wall 30 which extends transversely to the recess 28. The recess 28 extends substantially parallel to the bottom wall 12 and has a curved cross-section. A water discharge nozzle 32 extends through the transverse end wall 30 in substantial axial alignment with the longitudinal axis of the recess 28 and is connected to the water supply pipe 20. The nozzle 32 which may be integrally molded with the tub during the manufacture thereof extends through the transverse end wall 30 to terminate flush therewith inside the flow directing channel 26.

As a result of the above arrangement, the water is discharged into the tub 10 along the sidewall 16 in a direction towards the back end wall 18' and contours the tub walls to thereby flow within the tub along a circular path, as shown in FIG. 1. As the water fills the tub, the circulatory movement of the water also imparts to the bath water the same movement. There is thus a simultaneous mixing of the hot and cold water such that a uniform water mixture having a substantially constant temperature is obtained. Owing to the position of the flow directing channel 26 through which the water enters, a person may enter the bath during its filling and comfortably rest against the back end wall 18' without impeding the circulatory movement of the water which passes between the back of the person's body and the back end wall 18', as shown in FIG. 2.

I claim:

1. In a bathtub having a bottom wall, a pair of sidewalls and opposed first and second end walls integrally formed with said bottom wall, said second end wall being angularly inclined outwardly to define an abutment surface against which a person lying in the bathtub may rest, and water inlet means connected to hot and cold water supply means for filling said bathtub with a mixture of hot and cold water, whereby the improvement comprises only one of said sidewalls having a flow directing channel defined by an elongated recess, said elongated recess having a longitudinal axis, first and second ends and a transverse end wall at the first end of said recess extending transversely thereto, said recess being near said first end wall on said one sidewall and at a height above the buttocks of an individual seated in the bathtub and being curved in cross-section and tapering toward said second end to merge with said one sidewall in a direction toward said second end wall, and wherein said water inlet means comprises a single water discharge nozzle integral with said transverse end wall and extending therethrough in substantial axial alignment with the longitudinal axis of said recess so as to discharge a flow of hot and cold water along said one sidewall in a direction toward said second end wall and to impart to the water a circulatory movement as the water fills the bathtub, thereby uniformly mixing the hot and cold water and providing a uniform water mixture having a substantially constant temperature.

2. A bathtub as claimed in claim 1, wherein said elongated recess extends substantially parallel to said bottom wall.

3. A bathtub as claimed in claim 1, wherein said water discharge nozzle is integrally molded with said transverse end wall.

4. A bathtub as claimed in claim 1, wherein said water discharge nozzle extends through said transverse end wall to terminate flush therewith inside said flow directing channel.

* * * * *